US012222133B2

(12) United States Patent
Neelakantan et al.

(10) Patent No.: US 12,222,133 B2
(45) Date of Patent: Feb. 11, 2025

(54) DESICCANT COATED FAN BLADE

(71) Applicant: Palo Alto Research Center Incorporated, Palo Alto, CA (US)

(72) Inventors: Ravi Neelakantan, San Francisco, CA (US); Michael Benedict, Palo Alto, CA (US); Kathryn F. Murphy, San Francisco, CA (US); Mahati Chintapalli, Minnetonka, MN (US); Stephen Meckler, Palo Alto, CA (US)

(73) Assignee: Xerox Corporation, Norwalk, CT (US)

( * ) Notice: Subject to any disclaimer, the term of this patent is extended or adjusted under 35 U.S.C. 154(b) by 808 days.

(21) Appl. No.: 17/336,900

(22) Filed: Jun. 2, 2021

(65) Prior Publication Data

US 2022/0390127 A1 Dec. 8, 2022

(51) Int. Cl.

| | |
|---|---|
| ***F24F 3/14*** | (2006.01) |
| ***F24F 3/147*** | (2006.01) |
| ***F24F 3/153*** | (2006.01) |
| ***F24F 7/08*** | (2006.01) |

(52) U.S. Cl.

CPC ..... *F24F 3/1423* (2013.01); *F24F 3/147* (2013.01); *F24F 3/153* (2013.01); *F24F 7/08* (2013.01); *F24F 2003/1464* (2013.01)

(58) Field of Classification Search

CPC ..... F24F 5/0021; F24F 3/1423; F24F 3/14; F24F 3/153; F24F 7/08; F24F 2003/1464; F24F 2005/0067

See application file for complete search history.

(56) References Cited

U.S. PATENT DOCUMENTS

| | | | | |
|---|---|---|---|---|
| 4,262,210 | A * | 4/1981 | Yamine | F03D 9/14 290/55 |
| 6,772,534 | B2 | 8/2004 | Gomes et al. | |
| 10,421,253 | B2 | 9/2019 | Van Overmeere et al. | |
| 10,589,220 | B1 | 3/2020 | Dimaiolo et al. | |

FOREIGN PATENT DOCUMENTS

| | | |
|---|---|---|
| JP | 5022026 | 6/2012 |

OTHER PUBLICATIONS

Wikipedia "Silica Gel" Jul. 2020 (Year: 2020).*

Pastore et al., "Polymer—MOF Hybrid Composites with High Porosity and Stability through Surface-Selective Ligand Exchange", Chem Mater.30, 23, 2018, pp. 8639-8649.

Alsbaiee et al., "Rapid removal of organic micropollutants from water by a porous β-cyclodextrin polymer" Nature, 529, 2016, pp. 190-194.

Kirk et al., "The potential of polymers of intrinsic microporosity (PIMs) and PIM/graphene composites for pervaporation membranes", BMC Chemical Engineering, 2019, 19 pages.

(Continued)

*Primary Examiner* — Thuan D Dang

(74) *Attorney, Agent, or Firm* — Mueting Raasch Group

(57) ABSTRACT

A system and method utilize one or more fans each having fan blades. The fan blades have a desiccant material on an outer surface. The desiccant material is operable to adsorb airborne moisture in an ambient airflow and desorb moisture in a heated airflow. The fan blades are operable to drive one or both of the ambient airflow and heated airflow via rotation of the fan.

20 Claims, 5 Drawing Sheets

(56) References Cited

OTHER PUBLICATIONS

Ostermann et al., "Metal-organic framework nanofibers viaelectrospinning" Chem. Commun. 47, 2011, pp. 442-444.
Xue et al., "Electrospinning and Electrospun Nanofibers: Methods, Materials, and Applications", Chem Rev., 119(8), Apr. 24, 2019, pp. 5298-5415.
Zhang et al., "polyMOFs: A Class of Interconvertible Polymer-Metal-Organic-Framework Hybrid Materials", Angewandte Chemie, vol. 54, Issue 21, May 2015, pp. 6152-6157.
Zhang et al., "Polymer-Metal-Organic Frameworks (polyMOFs) as Water Tolerant Materials for Selective Carbon Dioxide Separations", Journal of the American Chemical Society, 138, 3, 2016, pp. 920-925.

* cited by examiner

DESICCANT COATED FAN BLADE

SUMMARY

The present disclosure is directed to a desiccant coated fan blade. In one embodiment, a system includes one or more fans each with fan blades. The fan blades include a desiccant material on an outer surface. The desiccant material is operable to adsorb airborne moisture in an ambient airflow and desorb moisture in a heated airflow. The fan blades are operable to drive one or both of the ambient airflow and heated airflow via rotation of the fan.

In another embodiment, a method involves driving an ambient airflow with fan blades of a rotating fan. The fan blades include a desiccant material on an outer surface. The desiccant material is operable to adsorb airborne moisture in the ambient airflow. A heated airflow is also driven with the fan blades of the rotating fan. The desiccant material is operable to desorb moisture in the heated airflow.

In another embodiment, system includes a desorbing chamber that includes: a heater that emits heat into the desorbing chamber; a first fan that drives a heated airflow within the desorbing chamber; an entrance path providing ambient makeup air to the heated airflow; and an exit path through which humid heated air from the heated airflow exits the desorbing chamber. The first fan includes first fan blades with a first desiccant material on an outer surface of the first fan blades that desorb moisture in the heated airflow. The system also includes a cooling partition having a second surface onto which the humid heated air is directed. A second fan of the system drives ambient air to a first surface of the cooling partition. The second includes second fan blades with a second desiccant material on an outer surface of the second fan blades that adsorb moisture in the ambient airflow. A water collector of the system collects condensate resulting from the humid heated air being directed onto the second surface of the cooling partition.

These and other features and aspects of various embodiments may be understood in view of the following detailed discussion and accompanying drawings.

BRIEF DESCRIPTION OF THE DRAWINGS

The discussion below makes reference to the following figures, wherein the same reference number may be used to identify the similar/same component in multiple figures. The drawings are not necessarily to scale.

DETAILED DESCRIPTION

Figure 1:
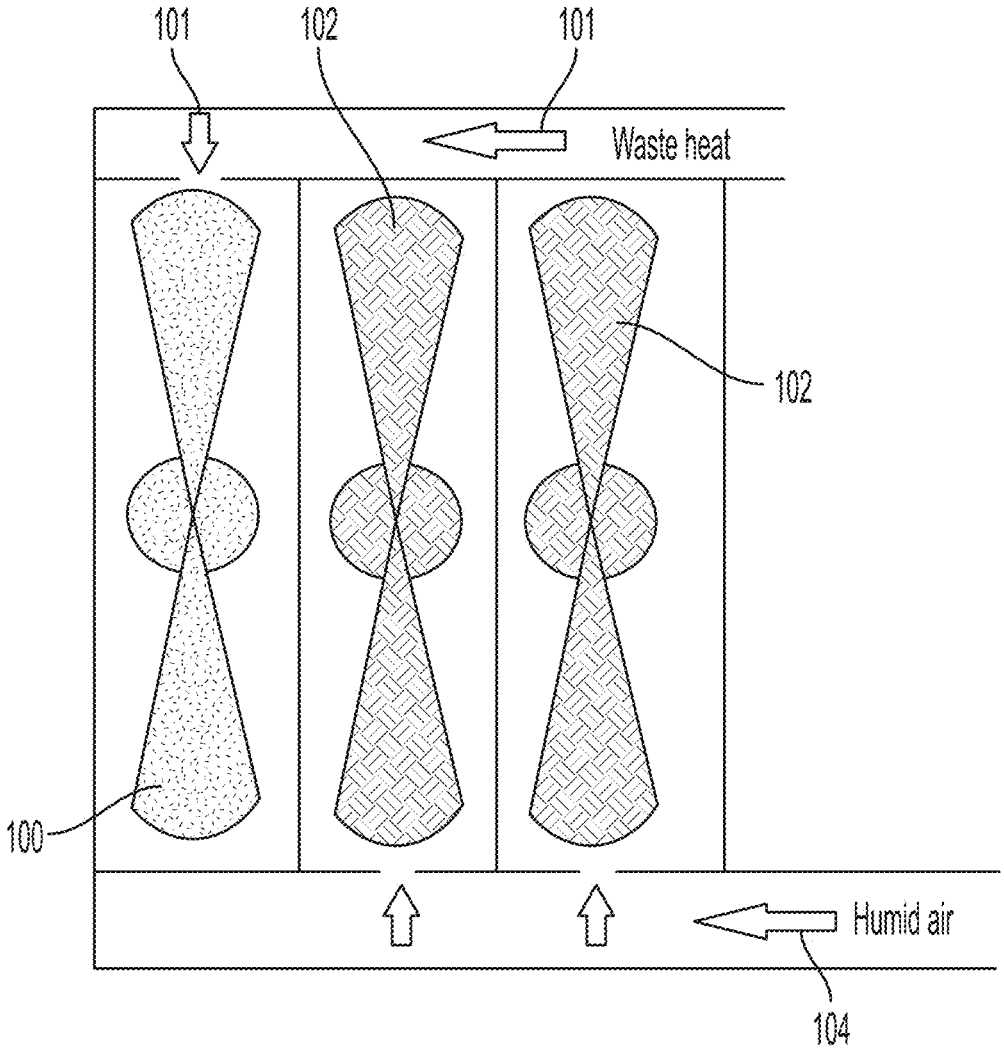
FIG. 1 is a block diagram showing an air processing system according to an example embodiment.

The present disclosure relates to climate control systems such as heating, ventilation, and air conditioning (HVAC). In the commercial sector, HVAC systems are a major energy consumer, and many solutions have been proposed to increase the energy efficiency of these systems. Humidity control alone can consume roughly a quarter to one third of the energy requirements on an HVAC system, depending on climate (see, e.g., Airedale: "Vodacom case study," www.airedale.com/web/About-Airedale/The-News-HVACNodacom.htm).

This disclosure relates to an efficient method of dehumidification and/or atmospheric water harvesting using a combination of desiccant materials and efficient integrated design. A fan with blades that includes a desiccant (e.g., a hierarchically porous, super-moisture absorbing material) on a surface of the blades is driven via a motor. The driving fan is used to circulate air, as in any HVAC system, while also optimizing convection at the surface of the moisture absorbing material, rather than directing air over a desiccant or cooling-coils. A desiccant material may use phase-changing polymers such as poly(N-isopropylacrylamide) combined with highly adsorbent materials such as Cl-doped polypyrrole is used which reduces the temperature required to regenerate the desiccant from >100 C to roughly 40 C, further increasing efficiency by allowing the material to be re-generated using low quality (waste) heat from other processes. Generally, low quality waste heat is heated air that is at a temperature <50 C, although may encompass higher temperatures, e.g., <60 C, <70 C, etc.

Existing dehumidifiers come in at least two forms, either in the form of mechanical or desiccant dehumidification. Mechanical dehumidification applies a vapor cycle similar to what is used in air-conditioners. Intake or recirculated air is over-cooled below its dew point by directing it over cooling-coils to condense the water vapor and reduce humidity. Afterward, the air is heated to its desired temperature before being circulated. This process is energy inefficient due to the over-cooling and heating cycles required to generate the dehumidified air. A desiccant dehumidifier uses a rotating wheel containing a regenerable desiccant to absorb moisture and reduce the humidity of incoming air. Hot air is passed through one part of the wheel as it rotates to regenerate the desiccant. Typical desiccant materials include nano-porous silica and zeolites which absorb moisture through capillary condensation. These materials need to be heated to temperatures exceeding 100 C in order to be regenerated. This heat is either generated through electrical heating or through waste heat sources.

In contrast to existing desiccant dehumidifiers, embodiments described herein may use a set of fans being run in parallel. The fans may have blades comprising an electrospun mat of a super moisture-sorbent material which readily absorbs atmospheric moisture down to 30% RH and has much lower cycling temperatures (~38 C, thus requiring lower quality heat) and also produces liquid water rather than vapor. Each fan's mass can be monitored in time, and once a steady state is reached the fan is heated using waste heat from building utilities (e.g., via a system of valves), which may be readily implemented in facilities with large quantities of information and computer technology (ICT) equipment, such as data centers or telecommunications installations. Other sources of waste heat may be used, such as heat from electrical or hydraulic motors in a manufacturing facility.

The dehumification (or water harvesting) system shown in FIG. 1 directs waste heat 101 to the water-filled fans 100 to regenerate the desiccant material. Humid air 104 is drawn to the regenerated fans 102. By eliminating a separate heat/mass exchanger, inefficiencies in redirecting air flow are eliminated. The volume taken up by fan blades in a separated system is also effectively eliminated. These two factors allow for a larger diameter fan to be used. Larger diameter fans have higher efficiencies and rotate at slower speeds for the same air flow rate while requiring the same or reduced motor size.

This disclosure describes an efficient method of dehumidification and/or atmospheric water harvesting using a combination of novel desiccant materials and efficient integrated design. A set of fans with blades comprising highly moisture-absorbing material is driven via a motor. The driving fan is be used to circulate air (either drawing in humid intake air over dry fan blades or waste heat over moisture-saturated blades using a set of control valves). As opposed to typical HVAC desiccant wheel systems, the fan is the desiccant rather than using a fan to re-direct air over a desiccant wheel. Use of desiccant fan blades reduces inefficiencies inherent in a desiccant wheel arrangement.

The embodiments described herein employ a material that can be regenerated with lower quality heat (e.g., lower temperature) and can uptake more moisture per unit mass than a typical desiccant. The highly-moisture sorbent material uses phase-changing polymers, such as poly(N-isopropylacrylamide), which undergo a phase change becoming hydrophobic above 40° C. as a means to regenerate the desiccant (from >100° C. for typical desiccants). An adsorbent material, such as Cl-dope polypyrrole, is typically added to the phase-changing polymer to increase its vapor absorption capacity and kinetics. These materials can be electrospun into fibrous mats with hierarchical structures and/or combined with cross-linking materials to generate monoliths of varying porosity and pore size distribution.

The system utilizes fan blades which act as the adsorption (and desorption) surface of the system. There may be at least two sets of blades on a central shaft driven by a single motor. As the fans rotate the blades will both be exposed to fresh air and generate air flow. In addition to using lower quality heat to desorb the moisture, the system will produce water in liquid rather than vapor form, which can be collected via gravity and re-used in other processes.

Figure 2:
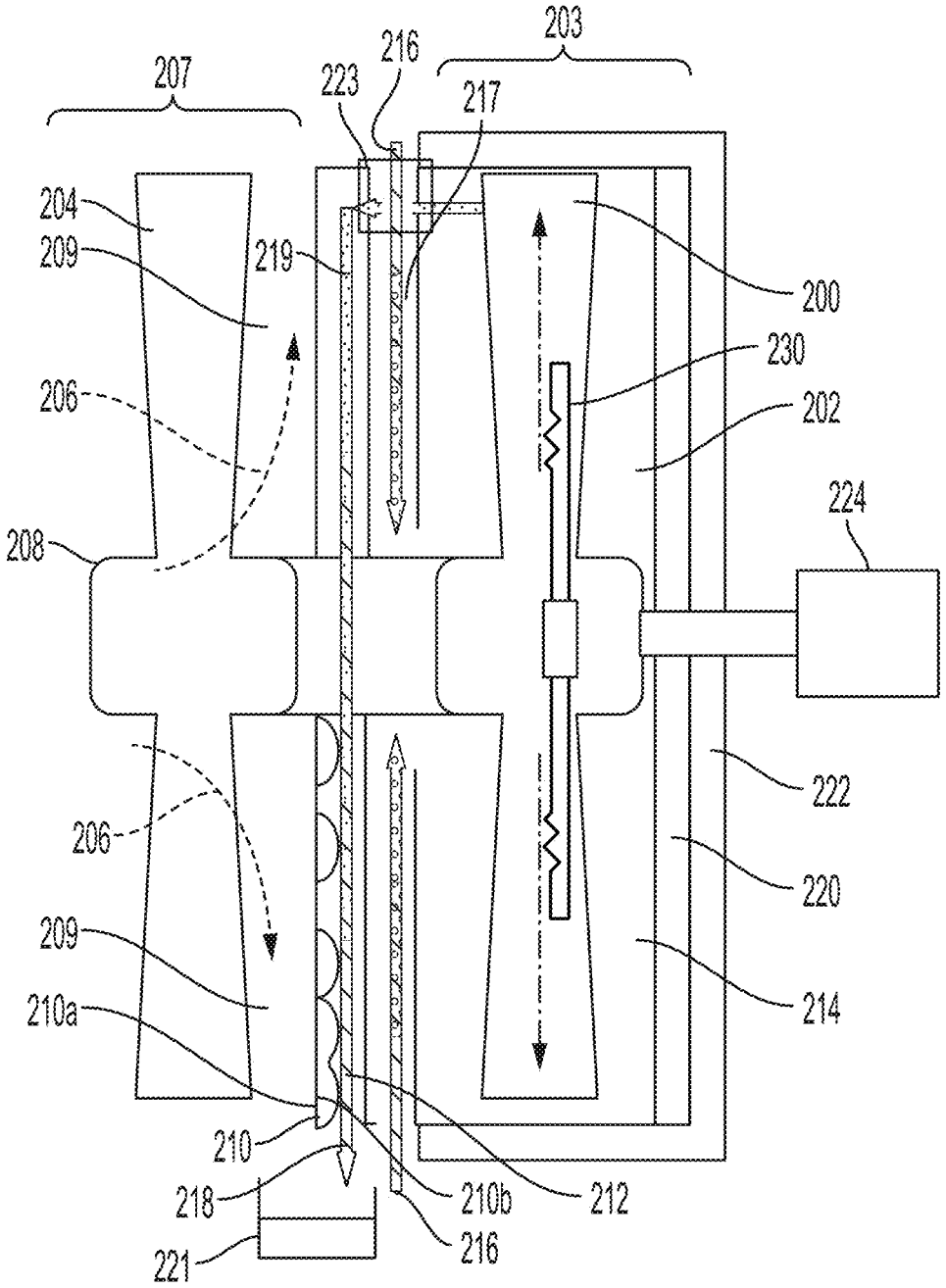
FIG. 2 is a block diagram showing an air processing system according to another example embodiment.

A cross sectional diagram of a system according to an example embodiment is shown in FIG. 2. A first fan 200 (or first set of fans) will be desorbing in an enclosed or semi-enclosed volume 202 on a desorption side 203 while a second fan 204 is adsorbing to ambient air 206 on an adsorption side 207. The adsorption side 207 may be open, semi-enclosed, or enclosed. On the adsorption side 207, ambient air 206 flows across the fan blades from regions 208 to region 209 where it is driven over a first surface 210*a* of a cooling partition 210, which cools a second surface 210*b* facing the contained desorption side 203 and opposed to the first surface 210*a*. The cooling partition 210 acts as a condenser and will be designed to have a large specific surface area and help encourage fluid flow 212. The fluid flow 212 is directed into a water collector 221, e.g., a channel or pipe.

The desorption side 203 utilizes circular flow that is directed from a heated wall 214 to the cooling partition 210 with a small amount of makeup air 216 that enters through entrance path 217 and exits through exit path 218 as humid heated air 219. The makeup air 216 can be pre-warmed by the humid heated air 219 using counter-flow heat exchanger 223 to minimize the amount of exergy exiting the system.

Heat is emitted into the desorption side 203 from heater 220 on the heated wall 214. The heater 220 may include a heat exchanger, heat generator (e.g., resistive heater, combustion heater), or other heater known in the art. In one embodiment, the heater 220 may include one or more of photovoltaic (PV) cells and solar thermal absorption layers. The PV cells can also be used to drive the fan motor 224, e.g., for a portable water harvesting device that is designed for off-the grid use. In another embodiment, the heater 220 may include a heat exchanger driven by waste heat.

In yet another embodiment, the system may include an internal heater 230 integrated into the fan blades (shown on first fan 200 in FIG. 2) instead of or in addition to the external heater 220. The internal heater 230 could be an electrically driven heater (e.g., resistive, inductive) as indicated schematically in FIG. 2. In other embodiments, the internal heater 230 may use cavities through which are driven a heated gas and/or liquid. All fans in the system (e.g., fans 200 and 204) may include the same type of internal heater 230, and these could be activated or deactivated depending on the operational mode of the fan, the modes being described elsewhere herein. In some embodiments, the internal heater 230 may switch operation to a cooler depending on an operational mode of the fan. This can be accomplished by driving different temperature fluids through internal cavities if the heater 203 is implemented this way, and/or using an electrically driven solid-state cooling device, e.g., a Peltier device.

The heater 220 (other parts of the chamber on the desorption side 203) can be coated in an insulator 222. If the heater 220 is a PV cell, transparent aerogels can be used as an insulator, which are described in commonly-owned U.S. Pat. No. 10,421,253, issued Sep. 24, 2019. The thickness of the insulator 222 can be determined based on an energy size and mass balance for the system, as well as insulating factor of the materials used. The energy efficiency of this system may be dependent, among other things, on the energy used for fan rotation, and on inefficiencies in the fan drive motor 224, air flow (e.g., flow resistance through paths 217, 218), and heater 220.

When a cycle is completed, the blades of fan 200 will be dried out and the blades of fan 204 will be saturated with water. At this point, the fans 200, 204 can be switched from respective desorber to adsorber sides or vice versa, which may be considered a change from a first mode to a second mode. Where the system is small, e.g., a portable water-harvesting device, the blades and hub of each the fans 200, 204 can be an integral piece which can be easily removed and reattached to the drive shaft without requiring tools. In such an embodiment, the heater 220 and insulation 222 of the desorber side 203 can be readily opened to facilitate the mode change. Since only the fans 200, 204 need to be moved, the entire thermal mass of the hot desorption side remains.

Combining the heat/mass exchanger with the fan helps to decrease system size and weight in several ways. By eliminating a separate heat/mass exchanger, inefficiencies in redirecting air flow are eliminated. The volume taken up by fan blades in a separated system is also effectively eliminated. These two factors allow for a larger diameter fan to be used. Larger diameter fans have higher efficiencies and rotate at slower speeds for the same air flow rate while requiring the same or reduced motor size.

Figure 3:
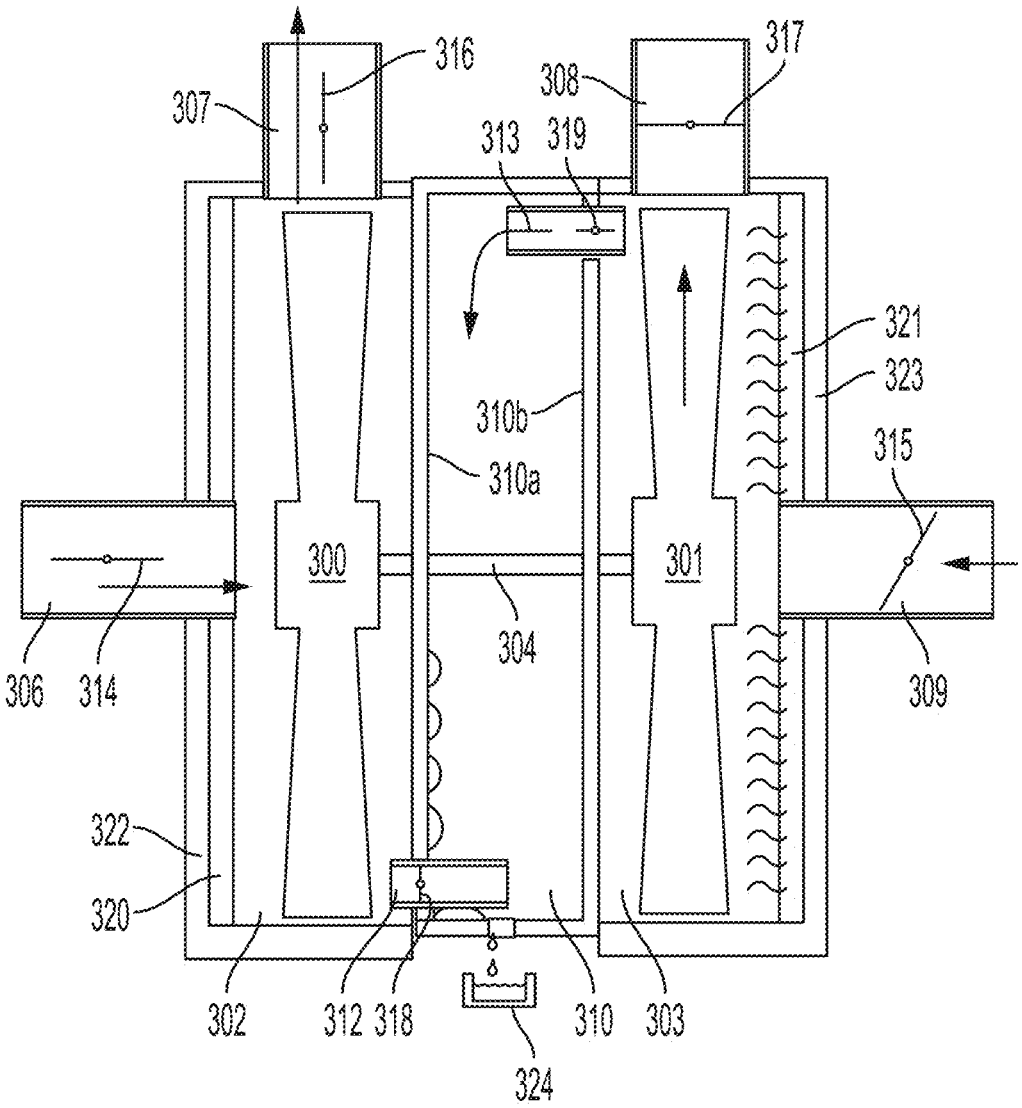
FIG. 3 is a block diagram showing an air processing system according to another example embodiment.

In another embodiment, an air treatment system can be devised such that switching of the fans is not needed. This may be useful for larger systems, such as HVAC or large water harvesting systems. An example of such a system is shown in the diagram of FIG. 3. Two fans 300, 301 are in separate chambers 302, 303. The fans 300, 301 are shown being driven by a common shaft 304, but other drive arrangements are possible. The chambers 302, 303 are similarly configured, with ambient air inlets 306, 307 and ambient air outlets 308, 309. A cooling chamber 310 is disposed between the chambers 302, 303, and ducts 312, 313 provide an air path between the chambers 302, 303 and the cooling chamber 310. Heaters 320, 321 and insulation 322, 323 surround part of the chambers 302, 303.

The ambient air inlets 306, 307 and ambient air outlets 308, 309 can be selectively opened and closed via respective valves 314-319 to reconfigure each chamber for desorbing or adsorbing. In this configuration, chamber 303 is configured as a desorbing chamber, with heater 321 activated, valve 315 slightly open to provide make-up air, and valve 319 open to allow heated and humid air to enter the cooling chamber 310. Chamber 302 is configure as an adsorbing chamber in this configuration, with valves 314 and 316 fully open to cause ambient air to be moved by fan 300 which adsorbs moisture. Fan 300 also cools cooling chamber wall 310*a*, which results in cooling chamber air condensing and leaving through liquid water channel 324.

By reversing the configuration of the valves 314-319 (e.g., valve 314 slightly open, valves 315, 317, and 318 open, and valve 319 closed), the chamber 303 can perform absorption and the chamber 302 can perform desorption. In such a case, wall 310*b* will be the cooling wall, heater 320 will be activated, and heater 321 will be deactivated. Note that the system may undergo a period of no activity (e.g., fans switched off, heaters deactivated, all valves closed) to allow the system to come to thermal equilibrium before changing modes.

The mode change described above can be triggered based on one or both of an adsorbing fan being saturated or a desorbing fan being desaturated. The system may include sensors to detect the saturation level of a fan. For example, the increased weight from higher sensor may be sensed using a torque sensor between the fan and a drive motor. Instead or in addition, a direct humidity sensor could be attached to a fan blade. Such sensor could transmit signals wirelessly or via a conductive rotating contact interface at the hub.

In order to achieve the structural requirements of the proposed design a mechanically robust composite of a polymer matrix containing the sorbent material can be used for the fan blades. Many methods have been explored to create composites of this type including incorporating crystalline fillers into a flexible polymer matrix (see, e.g., pubs.acs.org/doi/full/10.1021/acs.chemrev.9b00575); and covalently incorporating polymer backbones into active sorbents either postsynthetically (see, e.g., V. J. Pastore, T. R. Cook, J. Rzyev. Chem. Mater. 2018, 30, 8639-8649) or by synthesizing the MOF from a polymer ligand (see, e.g., Z. Zhang, H. T. H. Nguyen, S. A. Miller, A. M. Ploskonka, J. B. DeCoste, S. M. Cohen. J. Am. Chem. Soc. 2016, 138, 920-925, Z. Zhang, H. T. H. Nguyen, S. A. Miller, S. M. Cohen, Angew. Chem. Int. Ed. 2015, 54, 6152-6157).

One aspect in the design of the composite sorbent will be optimizing the tradeoff between large active area, low pressure drop, and mechanical robustness. This may be done with hierarchically porous systems, with porosity on multiple size scales so that surface area is high but flow impedance is low. Textiles, which have porosity on the scale of threads (100s of um to mm), individual fibers (100s of nm to 10s of um), and optionally pores in the fibers themselves (nms to 100s of nm) are one proposed solution. Polymer fibers may be easily and scalably fabricated via electrospinning. Hierarchically porous structures may also take advantage of aerogels, which have surface areas on the order of 100s of m2/g. A synthesis route for polymer aerogels has been developed (see, e.g., G. Iftime et al. Polymer Aerogel for Window Glazings, U.S. Pat. No. 10,421,253B2, Sep. 24, 2019) featuring surface areas >900 $m^2/g$.

Figure 4:
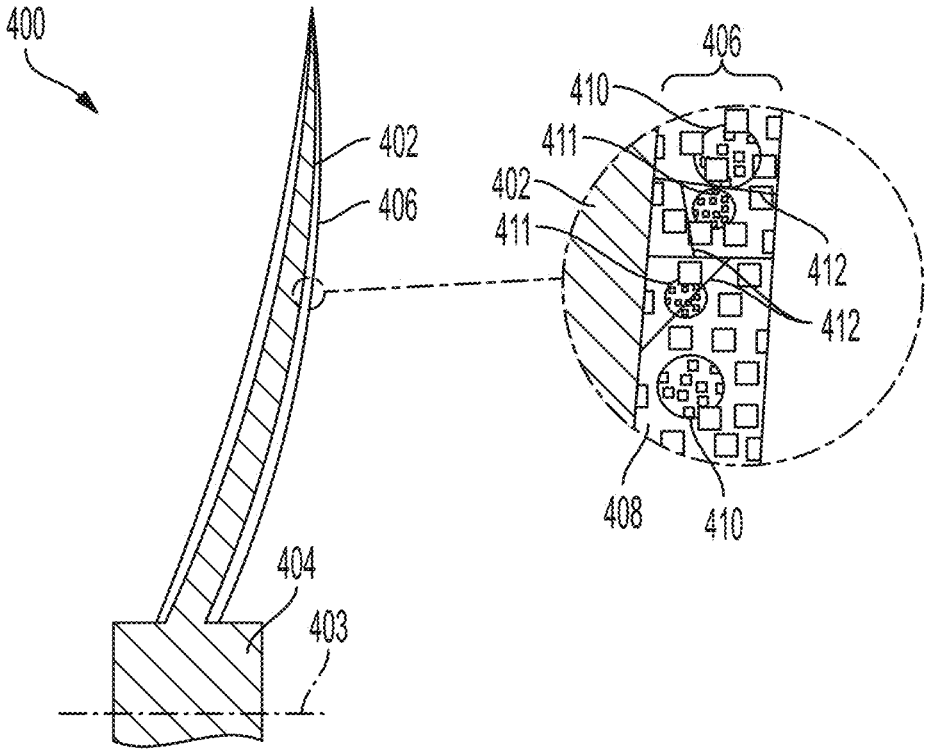
FIG. 4 is a cross-sectional view of a fan according to an example embodiment.

In FIG. 4, a cross sectional view shows details of a fan 400 according to an example embodiment. The fan 400 includes two or more blades 402 coupled to a hub 404. As shown here, the blades 402 and hub 404 may be formed integrally, e.g., cast, 3D printed, machined, etc. In other embodiments, the blades 402 may be formed separately from the hub 404 and attached in a final assembly of the fan 400. There may be at least two blades 402, and the blades 402 are generally arrayed radially about the hub 404 so that the fan 400 is balanced around a rotational axis 403. The blade 402 is shown with a solid core, however may be perforated or otherwise allow some amount of air (or other fluid) to migrate from one major surface to another.

The fan blade 402 and hub 404 may be made from the same or different materials (in the latter case where the blade 402 and hub 404 are not formed integrally). The material may include metals such as Al, Mg, corrosion resistant steel, etc. The material may also or alternatively include polymers, composites (e.g., fiberglass, carbon fiber). The materials of the fan blade 402 and hub 404 should at least be resistant to the corrosive effects of water/humidity and have sufficient mechanical properties (e.g., strength, toughness) to withstand the predicted mechanical loading on the fan blade 402 (e.g., transverse forces caused by driving airflow, centrifugal forces due to rotation) and hub 404 (e.g., centrifugal forces due to rotation, stresses caused by imbalances in the blades 402).

The blade 402 is shown coated with a desiccant material 406 that is operable to adsorb airborne moisture in an ambient airflow and desorb moisture in a heated airflow. The desiccant material 406 may, for example, include at least one of a phase-changing polymer, silica gel or zeolite adsorbent, metal-organic framework, ionic liquid, and halogen-doped nanoparticles. In another embodiment, the desiccant material 406 may include quaternary salt polymers, which have excellent water adsorbing properties. For example, poly (diallyldimethyl ammonium chloride) (PDADMAC) was used in a recent dehumidification project in synergistic combination with a phase-changing polymer, where the PDADMAC absorbs moisture from the air and the phase changing polymer takes up the moisture and swells. As seen in the detail view on the right side of FIG. 4, the desiccant material 406 includes a hierarchical porosity as seen in portions 410, 411 of lower porosity material being embedded within a higher porosity material 408.

Note that the portion 410 has higher porosity than portion 411, and this can be repeated with fewer or more portions of different porosity. Other material structures may also be introduced into the coating of desiccant material 406, such as fibers, nanowires, vias, etc., as illustrated by nanowire mesh 412 These structures may be formed of a material with high thermal conductivity, such as Ag, Cu, Au, Al, SiC, graphene, etc. These thermally conductive structures can reduce thermal gradients within the fan, such as within and along the coating of desiccant material 406.

In order to form the desiccant material 406 coating, controlled polymer aerogel synthesis and electrospinning can be used to produce hierarchically porous systems. The pore sizes can span a wide range of size scales, providing high surface area with low flow resistance. Metal-organic framework (MOF) particles can be added as inclusions, as has been demonstrated for ZIF-8 in PVP (see, e.g., R. Ostermann et al., Chem. Commun. 2011, 47, 442-444). Hydrophilicity of the porous support matrix can be enhanced through the incorporation of comonomers such as β-cyclodextrin (see, e.g., A. Alsbaiee, B. J. Smith, L. Xiao, Y. Ling, D. E. Helbling, W. R. Dichtel, Nature, 2016, 529, 190-194) or through blending with hydrophilic polymers of intrinsic microporosity (see, e.g., R. A. Kirk, M. Putintseva, A. Volkov, P. M. Budd. BMC Chem. Eng. 2019, 1, 18), as needed. Other additives such as Ag nanowires or sacrificial materials can optionally increase surface area and conductivity (see, e.g., J. Xue et al., Chem. Rev., 2019, 119, 5298-5415).

Figure 5:
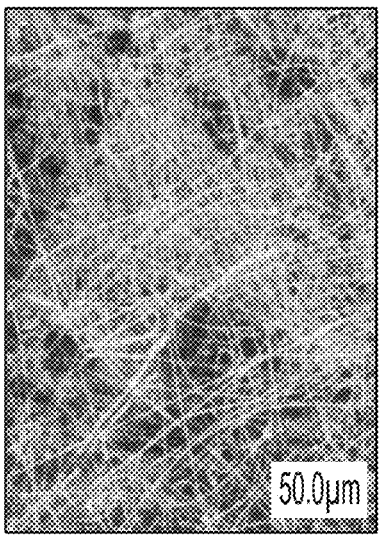
FIG. 5 is a microscopic image of an electrospun structure usable in a desiccant fan blade according to an example embodiment.

In FIG. 5, a microscopic image shows an example of an electrospun structure according to an example embodiment. Electrospinning is considered a likely candidate for covering fan blades with desiccant as described above. In other embodiments, MOF sorbents may be incorporated into mesoporous polymer aerogels with controlled pore architectures, and may yield a complimentary platform for sorbent fan blade production. Blades can be produced by cutting and shaping monolithic nonwoven mats. In other embodiments, the blade shape can be fabricated from a lightweight, conductive scaffold such as a mesh or foil, and electrospinning can occur directly onto the blades.

One characteristic that may be optimized in a system as described herein is electrical efficiency. The efficiency of the electrical system can determine the fan operation characteristics along with the back pressure imposed by the adsorption/desorption subsystems. In some embodiments, the supply air can flow in channels past the surface of the polymer films. This leads to convection-diffusion type problem where Peclet number determines the transport rates. Composite material properties can be estimated using experimentally obtained pure MOF and composite material sorption characteristics. Commercially available software can provide computer simulations of 3D airflow and conjugated heat and mass transfer models using Reynolds averaged Navier-Stokes equations coupled with energy and species equation using.

Figure 6:
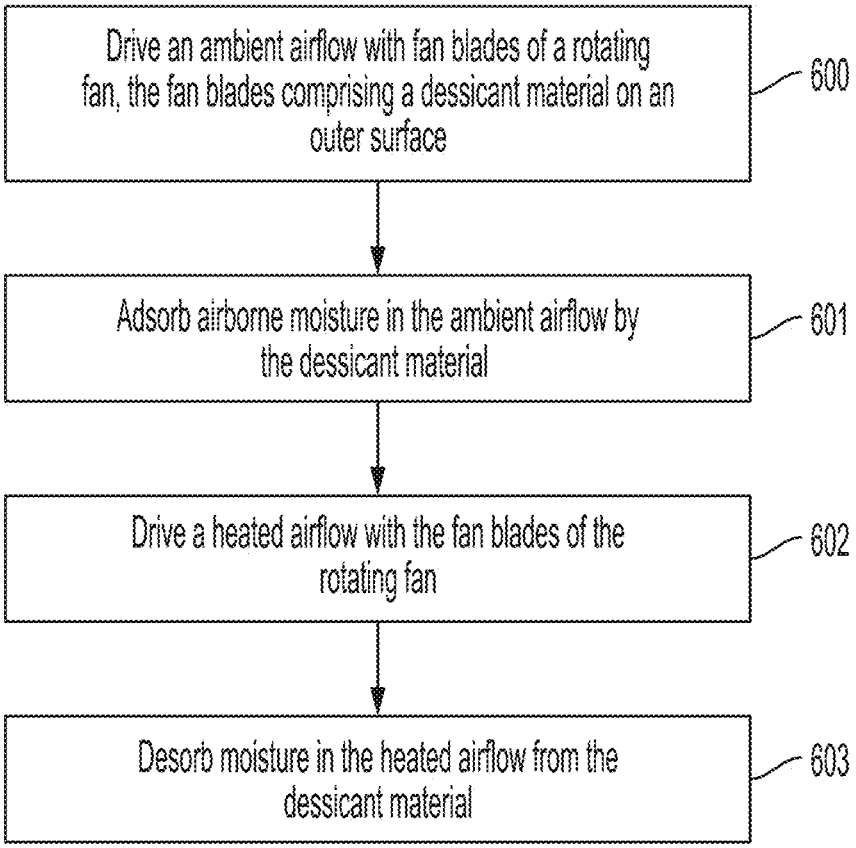
FIG. 6 is a flowchart of a method according to an example embodiment.

In FIG. 6, a flowchart shows a method according to an example embodiment. The method involves driving 600 an ambient airflow with fan blades of a rotating fan, the fan blades comprising a desiccant material on an outer surface. The airborne moisture is adsorbed 601 in the ambient airflow by the desiccant. A heated airflow is driven 602 with the fan blades of the rotating fan. The desiccant material desorbs 603 moisture to the heated airflow.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

The various embodiments described above may be implemented using circuitry, firmware, and/or software modules that interact to provide particular results. One of skill in the arts can readily implement such described functionality, either at a modular level or as a whole, using knowledge generally known in the art. For example, the flowcharts and control diagrams illustrated herein may be used to create computer-readable instructions/code for execution by a processor. Such instructions may be stored on a non-transitory computer-readable medium and transferred to the processor for execution as is known in the art. The structures and procedures shown above are only a representative example of embodiments that can be used to provide the functions described hereinabove.

The foregoing description of the example embodiments has been presented for the purposes of illustration and description. It is not intended to be exhaustive or to limit the embodiments to the precise form disclosed. Many modifications and variations are possible in light of the above teaching. Any or all features of the disclosed embodiments can be applied individually or in any combination are not meant to be limiting, but purely illustrative. It is intended that the scope of the invention be limited not with this detailed description, but rather determined by the claims appended hereto.

The invention claimed is:

1. A system comprising:

one or more fans each comprising fan blades, the fan blades comprising a desiccant material on an outer surface of the fan blades;

an ambient airflow that flows across the fan blades to adsorb airborne moisture in from the ambient airflow to the desiccant material; and a heated airflow that flows across the fan blades to desorb moisture from the desiccant material via the heated airflow, the fan blades being operated to drive one or both of the ambient airflow and heated airflow via rotation of the fan.

2. The system of claim 1, wherein the desiccant material comprises at least one of a phase changing polymer, silica gel or zeolite adsorbent, metal-organic framework, ionic liquid, and halogen-doped nanoparticles.

3. The system of claim 1, wherein the desiccant material comprises a hierarchical porosity wherein portions of lower porosity material are embedded with a higher porosity material.

4. The system of claim 1, further comprising heat conductive fibers, nano-wires, or vias embedded within the desiccant material.

5. The system of claim 1, further comprising:

a desorbing chamber comprising:

a heater that emits heat into the desorbing chamber;

a first fan of the one or more fans that drives the heated airflow within the desorbing chamber, first fan blades of the first fan desorbing moisture in the heated airflow;

an entrance path providing ambient makeup air to the heated airflow; and an exit path through which humid heated air from the heated airflow exits the desorbing chamber;

a cooling partition having a second surface onto which the humid heated air is directed;

a second fan of the one or more fans that drives ambient air to a first surface of the cooling partition, second fan blades of the second fan adsorbing the moisture in the ambient airflow; and a water collector that collects condensate resulting from the humid heated air being directed onto the second surface of the cooling partition.

6. The system of claim 5, further comprising a counter-flow heat exchanger that couples heat from the humid heated air into the ambient makeup air.

7. The system of claim 5, wherein the desiccant material comprises at least one of a phase changing polymer, silica gel or zeolite adsorbent, metal-organic framework, ionic liquid, halogen-doped nanoparticles, and a quaternary salt polymer.

8. The system of claim 5, wherein the desiccant material comprises a hierarchical porosity wherein portions of lower porosity material are embedded with a higher porosity material.

9. The system of claim 1, wherein the system is a heating, ventilation, and air-condition (HVAC) system.

10. The system of claim 9, wherein a dehumidified airflow resulting from the adsorption of the airborne moisture in the ambient airflow is circulated in the HVAC system.

11. The system of claim 9, wherein the heated airflow is heated by waste heat from building utilities.

12. A system comprising:

one or more fans each comprising fan blades, the fan blades comprising a desiccant material on an outer surface of the fan blades, wherein the desiccant material comprises a quaternary salt polymer, the desiccant material being operable to adsorb airborne moisture in an ambient airflow and desorb moisture in a heated airflow, the fan blades being operable to drive one or both of the ambient airflow and the heated airflow via rotation of the one or more fans.

13. The system of claim 12, wherein the desiccant material comprises a phase change polymer in combination with the quaternary salt polymer.

14. A system comprising:

a first fan and a second fan each comprising fan blades, the fan blades comprising a desiccant material on an outer surface of the fan blades, the desiccant material being operable to adsorb airborne moisture in an ambient airflow and desorb moisture in a heated airflow, the fan blades being operable to drive one or both of the ambient airflow and the heated airflow via rotation of the one or more fans, the system further comprising a chamber housing the first fan, the second fan being located outside of the chamber.

15. The system of claim 14, further comprising:

a cooling partition having a first surface that is cooled by ambient air driven by the second fan; and a flow path that feeds the heated airflow from the chamber to a second surface of the cooling partition opposite the first surface, wherein the moisture in the heated airflow is condensed and collected at the second surface.

16. The system of claim 14, wherein at least one surface of the chamber is heated by a heater.

17. The system of claim 16, wherein the heater comprises a photovoltaic heater.

18. The system of claim 16, wherein an outer surface of the heater is insulated by a transparent aerogel.

19. The system of claim 16, wherein the heater comprises a heat exchanger driven by waste heat.

20. The system of claim 16, wherein the heater comprises an internal heater integrated into the fan blades.

* * * * *